United States Patent [19]

Höft et al.

[11] Patent Number: 4,690,297

[45] Date of Patent: Sep. 1, 1987

[54] OPENING MEANS FOR OBLONG CANS

[75] Inventors: Peter Höft, Braunschweig, Wolfgang Peter, Cuxhaven; Johann Bergsteiner, Bremerhaven; Günter Berschiek, Geversdorf; Wolfgang Drobe, Bremerhaven; Fritz Engelke, Cuxhaven; Heinz Hacke, Cuxhaven; Walter Hebbinghaus, Cuxhaven; Siegfried Kuhnert, Cuxhaven, all of Fed. Rep. of Germany

[73] Assignee: Schmalbach-Lubeca AG, Braunschweig, Fed. Rep. of Germany

[21] Appl. No.: 914,114

[22] Filed: Oct. 1, 1986

[30] Foreign Application Priority Data

Oct. 2, 1985 [DE] Fed. Rep. of Germany ..... 3535226

[51] Int. Cl.[4] ..... B65D 17/34

[52] U.S. Cl. ..... 220/273

[58] Field of Search ..... 220/269-273

[56] References Cited

U.S. PATENT DOCUMENTS

| | | | |
|---|---|---|---|
| 3,478,918 | 11/1969 | Zundeh | 220/273 |
| 3,591,037 | 7/1971 | Schrecker et al. | 220/273 |
| 3,653,536 | 4/1972 | Schrecker | 220/273 |
| 3,682,350 | 8/1972 | Baugh et al. | 220/273 |
| 3,735,892 | 5/1973 | Kinkel | 220/273 |
| 4,593,834 | 6/1986 | Hoft et al. | 220/273 |

*Primary Examiner*—George T. Hall

*Attorney, Agent, or Firm*—Karl F. Ross; Herbert Dubno

[57] ABSTRACT

There is provided a tin lid for use with cans of oblong shape in Hansa format, which includes in its lid image section a tear-open portion defined by a self-contained recessed line capable of being broken up at one end of the lid by means of a pull-open ring attached to this end. At the other end, said recessed line includes a straight recessed line portion which extends in chordal-type fashion with respect to the core wall shaped like an arc of a circle and which is positioned perpendicular and symmetrically to the longitudinal lid center line and is further connected with the other recessed line components through an also chordal-type or polygonal recessed line connecting portion. This tear-open portion area defined by the polygonal arrangement of the recessed line, above all, is stiffened by a group of like and completely uniformly distributed beads, which are further associated with the chordal-type recessed line portion in predetermined manner, to so ensure the tear-open portion's final separation from the remaining lid section virtually without any remarkable capacity of the lid image section to undergo spring movement itself.

8 Claims, 2 Drawing Figures

OPENING MEANS FOR OBLONG CANS

Figure 1:
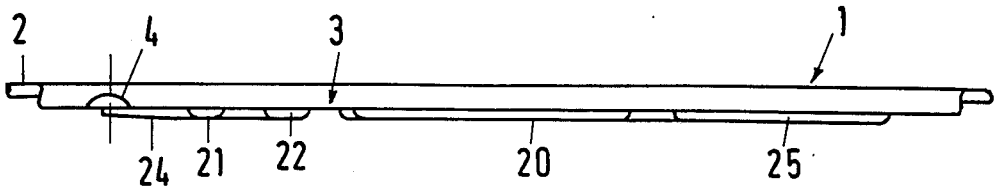

This invention relates to a tin lid for out-of-round cans, in particular, cans of oblong shape in Hansa format, comprising the features of the generic clause of the patent claim 1.

Such type of tin lid forms the subject matter of the older patent application No. P 34 30 382.0 by the same applicant. This type of lid design serves to avert the danger of splashing or even, of being injured by the tear-off edge of the tear-open portion in the last phase of separating the tear-open portion from the can, even more and even more reliably than hitherto possible, to so essentially facilitate can handling upon opening. Above all, this is ensured by the predetermined, polygonal extension of the recessed line in the end section of the tear-open portion.

Such types of lids having differently oriented or differently formed beads in both the starting area and end section of the tear-open portion are already known and there is a great variety of bead forms in the end section. The most frequently employed arrangement of beads is that illustrated in the FIG. 2 of the patent application No. P 34 30 382.0 mentined hereinafore. This type of bead arrangement has the effect that the tear-open portion is stiffened in the starting area in directions transversely to the longitudinal lid center line while an easier sheet rolling movement is enabled in this area as the can is opened, whereas in the end section, the tear-open portion sheet is stiffened in a direction parallel to the longitudinal lid center line and thus in a direction parallel to the tear-open direction by means of beads also extending parallel to this direction. This type of end section stiffening is of particular importance in connection with the particular, polygonal form of the recessed line in the end section of the tear-open portion according to the teaching provided by the patent application No. P 34 30 382.0.

It is an object of the present invention to still essentially enhance the stiffening effect in the tear-open portion end section and to particularly adapt it to the specific extension of the recessed line in this region.

This task is solved by the teaching provided by the patent claim 1.

Both the design and the arrangement of the beads in the tear-open portion end section according to the teaching provided by claim 1 have the effect that the tear-open portion sheet shows a stiff, board-like characteristic at least over the entire width of the chordal-type recessed line portion and over a substantial length measured along the longitudinal lid center by means of which a sheet warping is decisively lessened directly up to the straight or chordal-type recessed line portion. As a consequence it is ensured that up to the two end points of the chordal-type recessed line portion it will be possible to reliably and easily shear the recessed line virtually without any substantial warping in this area to so achieve a safe handling of the stiff tear-open portion in the last stage of separation along the straight, chordal-type recessed line portion in order to finally sever the tear-open portion from the remaining lid sheet by moving it up and down, without any elastic deformation forces being stored in the tear-open portion. What is essential in this connection, is the uniform stiffening effect over the entire width of the straight, chordal-type recessed line portion up to the end points of this recessed line portion. It is only by this feature that a uniform, guided severing operation is ensured by moving the tear-open portion up and down.

Preferably, the two outer beads of the group of beads are oriented opposite to the end points of the chordal-type recessed line portion according to the teaching provided by patent claim 2. Opening along the recessed line up to the end points is thus safely guided, because the bead ends are positioned near to the transition zone between end points and adjacent recessed line portions. At the same time, it is ensured that any deformation of the sheet in the last stage of the separating operation is largely excluded also in the end point regions.

To dimension the length of the group of beads relative to the length of the tear-open portion end section within the meaning indicated in patent claim 3 will have an advantageous effect.

When beads are arranged and distributed according to the patent claims 4 and 6, the capacity of storing spring-back forces in the tear-open portion as the can is opened will further be substantially reduced. In this case, the outer areas of the tear-open portion end section as well are stiffened in a manner corresponding to that used for the area opposite to the chordal-type recessed line portion. The stiffening of the tear-open portion is partly extended toward the lid center area to so counteract the storage of spring-back forces in this area as well. It will be particularly advantageous in this case when the distance between the beads and the lateral recessed line portions is as small as possible.

What is essential in this connection is that the tear-open portion is virtually uniformly stiffened over the entire width thereof, which means, in the center area of the tear-open portion and near the lateral recessed line portions.

Figure 2:
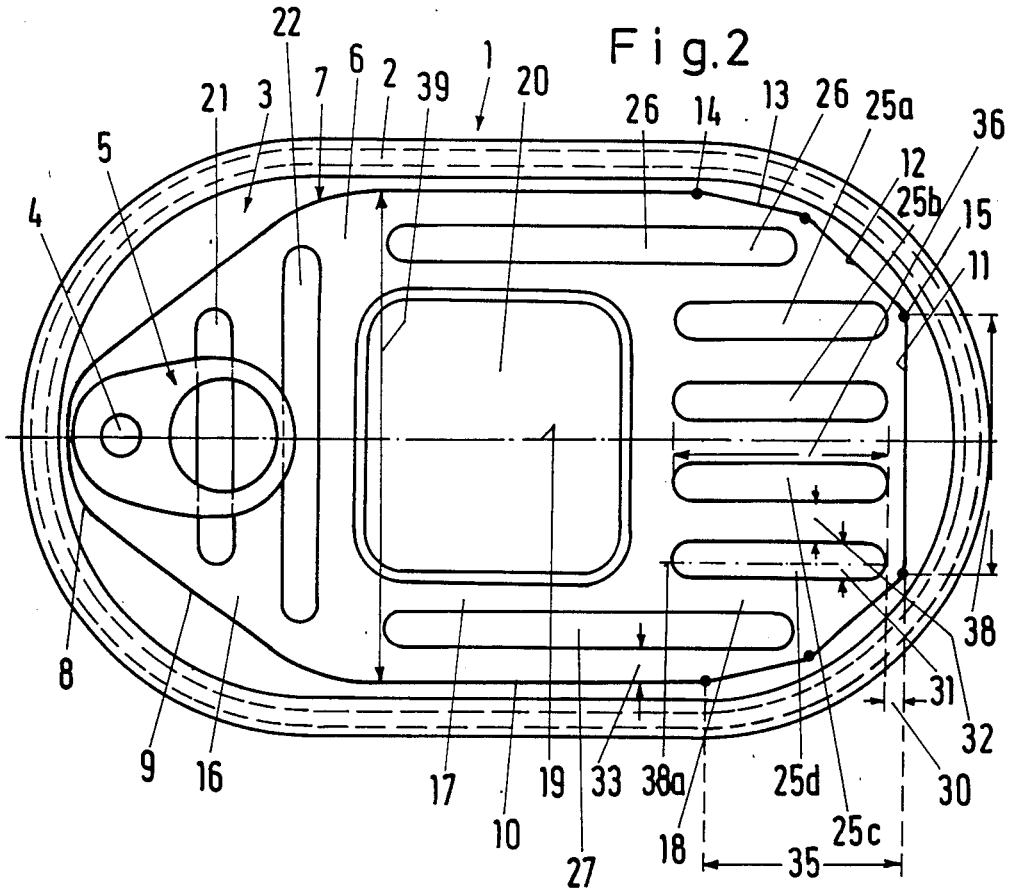

The invention will hereinafter be described in more detail on the basis of one embodiment and with reference to the accompanying drawings, wherein FIG. 1 shows a longitudinal section of a lid according to the invention and FIG. 2 is a top view of the lid according to FIG. 1.

The lid may be made of aluminum sheet but also of any other kind of thin sheet material. The lid is of oblong shape as is widely employed in fish cans in what is referred to as Hansa format. The sheet material may be of small thickness, in particular, below 0.24 mm.

Lid 1 has a flanged edge 2 changing into what is referred to as lid image section 3 through a core wall. A tear-open portion 6 is defined by a self-contained recessed line 7 in the lid image section 3, the extension of said recessed line deviating from the extension of the core wall. On the left side of FIG. 2, the recessed line has a starting portion 8 in the vicinity of which a pull-open ring 5 of common design is fixed by means of rivet 4 formed out of the sheet.

The recessed line diverges from tear-off starting line portion 8 in two straight portions 9 which define the entire starting area 16 of tear-open portion 6. In the starting area 16 two transversely extending beads 21, 22 of increasing length in tear-open direction are formed. In the center area 17 of tear-open portion 6 there is provided a planar depressed portion 20 of approximately square configuration, said depressed portion being defined by a corresponding shoulder. On either side of the depressed portion 20 extend beads 26, 27 parallel to the two outer straight recessed line portions 10 as well as parallel to the longitudinal center line 19 of the lid and to the core wall. Beads 26, 27 are greater in length than depressed portion 20 and are greater in length than center area 17 of tear-open portion 6. Consequently, they project into end section 18 of tear-open portion 6 by a remarkable portion.

It is apparent, that beads 26, 27 substantially may be positioned in equally spaced apart relation from the recessed line 10 and the shoulder defining depressed portion 20, respectively. In the preferred embodiment, the distance 33 between beads 26, 27 and recessed line portions 10 is as small as possible and corresponds to the bead width (31) at the most.

Beads 26 and 27 terminate in the end section 18 of tear-open portion 6 directly in the region of a transition point between recessed line portions 12 and 13, actually, at a small distance of a few millimetres. Recessed line portions 12 and 13 belong to a polygonal train of individual recessed line portions 11, 12 and 13 which are straight in themselves, are connected with the lateral straight recessed line portions 10 via points 14 and determine the end section 18 of tear-open portion 6. The center portion 11 of this polygonal train is a recessed line 11 extending in chordal-type fashion with respect to the arc-shaped core wall and having a straight length 38 which approximately corresponds to half the total width 39 of the tear-open portion 6. The distance between recessed line portion 11 and core wall measured along the longitudinal center line 19 may range between 2 and 15 mm and, preferably, is approximately 10 mm.

In the embodiment shown, the center straight or chordal-type recessed line portion 11 in the end section 18 of tear-open portion 6 is associated with four beads equally distributed and equal in length 36. The distance from the center of the one outer bead **25*a* to the center of the other outer bead 25*d* approximately equals the length 38 of the chordal-type recessed line portion 11, which means, the longitudinal center lines 38*a* of the beads are almost in alignment with the end points 15 of the recessed line portion 11. Preferably, as indicated, the beads are completely uniformly distributed over the length 38 of the recessed line portion 11. Thereby the width 31 of the bead—in the illustrated, preferred embodiment—approximately equals the width 32 of the undeformed sheet area between adjacent beads. Beads 25 are also equal in length 36, in the preferred embodiment according to FIG. 2, this length at least equals the length 35 of the end section of tear-open portion 6, measured parallel to the longitudidnal center line 19 of the lid and between the chordal-type recessed line portion 11 and the transition points 14 of the recessed line changing into the straight, lateral recessed line portions 10 so that beads 25 extend beyond the connecting line between transition points 14 in a direction toward the starting area. As a consequence, the board-like effect is increased. It is apparent from FIG. 2, that beads 26 and 27 harmoniously fit into the distribution arrangement of the group of beads 25*a*–25*d* in the end section 18 of the tear-open portion. In the preferred embodiment according to FIG. 2, beads 25 to 27** therefor are of like widths and include like, undeformed intermediate areas.

The beads approach the polygonal recessed line in the end section 18 of the tear-open portion to the largest possible extent. The distance 30 between the end points of beads 25 and the chordal-type recessed line portion 11 ranges between approximately 1 mm and approximately 7 mm and, preferably, is smaller than the width 31 of the beads and, in the preferred embodiment shown, ranges from approximately 0.5 mm to approximately 3 mm.

The type of bead distribution in conjunction with the polygonal extension of the recessed line in the end section 18 of tear-open portion 6 ensures a particularly safe handling as the can is opened, which is further also effective against the tendency to undergo spring movement as the tear-open portion is separated from the remaining lid sheet. The ribs and the thus resulting stiffening effect ensure—though no particular attention is paid to can opening—that the tear-open force is directed parallel to the longitudinal center line 19 of the lid, whereby the tear-open operation automatically terminates at the end points 15 of the chordal-type recessed line portion 11 for the time being, to so exclude an unexpected separating step which might cause the tear-open portion to undergo spring movement. The final separating operation is very safely guided due to the fact that the lid sheet is uniformly stiffened and, consequently, also a uniform separation is ensured by moving the tear-open portion up and down about the joint axis formed by the chordal-type recessed line portion 11.

Owing to the new features a more easy and comfortable handling of the tear-open portion is acheived upon can opening.

We claim:

1. A tin lid, in particular, of aluminum sheet, for out-of-round cans, in particular, cans of oblong shape in Hansa-format, comprising a tear-open portion which takes up almost the greatest part of the lid image section defined by the lid core wall, is enclosed by a self-contained recessed line having a starting portion in the area of one lid end and extending closely adjacent to the longitudinal sides and parallel to the lid edge, and, in the area near the starting portion, has secured thereto a lever-type pull-open ring so as to be in flat contact with the tear-open portion, the end of the pull-open ring extending in the longitudinal lid direction, and which is defined by a recessed line portion at the end of the lid remote from the starting portion, said recessed line portion extending in chordal-type fashon with respect to the arc-shaped extension of the core wall and having a length which equals almost half the greatest width of the tear-open portion spaced apart from the lid core wall—measured alaong the longitudinal lid center line at a distance between approximately 2 mm and 15 mm, and in the case of which lid, the tear-open portion is stiffened in various manners by means of a plurality of beads or the like which are oriented approximately transversely to the longitudinal center line in the starting area and, approximately parallel to the longitudinal center line, in the other areas, characterized in that over the entire width (38) of the chordal-type recessed line portion (11) the beads (25) extending substantially parallel to the longitudinal center line (19) are spaced from the chordal-type recessed line portion (11) at equal distances (30) of between approximately 1 mm and approximately 7 mm and the width (31) of the beads approximately equals the width of the undeformed area (32) intermediate adjacent beads (**25*a*–25*d***).

2. A lid according to claim 1, characterized in that four beads (**25*a*–25*d*) are distributed over the width (38) of the chordal-type recessed line portion (11), the longitudinal center line (38*a*) of each of the two outer beads being almost in alignment with the associated end point (15) of the chordal-type recessed line portion (11**).

3. A lid according to claim 1, characterized in that the length (36) of the beads (**25*a*–25*d*) associated with the chordal-type recessed line portion (11**) at least equals the length (35)—measured parallel to the longitudinal center line (19) of the lid—of the tear-open portion (6) between the end point (14) of the straight recessed line portions (10) parallel to the longitudinal center line and the end point (15) of the chordal-type recessed line portion (11) such that said beads (25*a*–25*d*) extend beyond the connecting line of the end points (14) of the recessed line portions (10) parallel to the longitudinal lid sides in a direction toward the starting area.

4. A lid according to claim 1 characterized in that over the entire width (39) of the tear-open portion (6) there are provided 6 beads (25–27) of like width and having undeformed intermediate areas of like width between adjacent beads and between said beads and the recessed line portion (10) parallel to the longitudinal center line (19) of the lid, the ends of the beads being spaced from the directly adjacent recessed line area at approximately equal distances and at least the two outmost ones of said beads (26, 27) respectively extending approximately up the starting area (16) of the tear-open portion.

5. A lid according to claim 1, characterized in that the distance (30) between the end of the beads associated with the chordal-type recessed line portion (11) and said chordal-type recessed line portion (11) is smaller than the width (31) of the beads and, preferably, amounts from approximately 0.5 mm to approximately 3 mm.

6. A lid according to claim 4, characterized in that the distance (33) between the two outer beads (26, 27) and the lateral recessed line portions (10) does not exceed the width (31) of the beads and, preferably, is a minimum distance (33) of between approximately 0.5 mm and approximately 3 mm.

7. A lid according to claim 4 characterized in that the two outer beads (26, 27) respectively terminate in direct vicinity of a transition point between the recessed line portions (12, 13) of the polygonal recessed line area in the end section of the tear-open portion.

8. A lid according to claim 2 characterized in that the center distance beween the two outer ones of said four identical beads (25) approximately equals the length (38) of the chordal-type recessed line portion (11).

* * * * *